US006363762B1

(12) United States Patent
Kueng

(10) Patent No.: US 6,363,762 B1
(45) Date of Patent: Apr. 2, 2002

(54) LOCKING DEVICE

(75) Inventor: Otto Kueng, Dietlikon (CH)

(73) Assignee: Kaba Schliessysteme AG, Wetzikon (CH)

( * ) Notice: Subject to any disclaimer, the term of this patent is extended or adjusted under 35 U.S.C. 154(b) by 0 days.

(21) Appl. No.: 09/331,699

(22) PCT Filed: Dec. 8, 1997

(86) PCT No.: PCT/CH97/00458

§ 371 Date: Jul. 30, 1999

§ 102(e) Date: Jul. 30, 1999

(87) PCT Pub. No.: WO98/28508

PCT Pub. Date: Jul. 2, 1998

(30) Foreign Application Priority Data

Dec. 24, 1996 (CH) ..... 3192/96

(51) Int. Cl.[7] ..... E05B 47/06; E05B 49/02

(52) U.S. Cl. ..... 70/278.3; 70/278.6; 70/278.7; 70/283.1

(58) Field of Search ..... 70/278.3, 278.6, 70/278.7, 283, 283.1

(56) References Cited

U.S. PATENT DOCUMENTS

| | | | | | |
|---|---|---|---|---|---|
| 1,795,283 | A | * | 3/1931 | Johnson | 70/283 |
| 2,028,852 | A | * | 1/1936 | Vincent | 70/283 |
| 4,633,687 | A | * | 1/1987 | Fane | 70/278.3 X |
| 4,789,859 | A | * | 12/1988 | Clarkson et al. | 70/278.3 X |
| 5,010,750 | A | * | 4/1991 | Böser et al. | 70/278.3 X |
| 5,018,375 | A | * | 5/1991 | Tully | 70/283 X |
| 5,421,178 | A | * | 6/1995 | Hamel et al. | 70/283 |
| 5,437,174 | A | * | 8/1995 | Aydin | 70/278.3 |
| 5,542,274 | A | * | 8/1996 | Thordmark et al. | 70/283 X |
| 5,640,863 | A | * | 6/1997 | Frolov | 70/283 |
| 5,699,686 | A | * | 12/1997 | Neumayer et al. | 70/283 |
| 5,715,715 | A | * | 2/1998 | Nunez | 70/283 |
| 6,079,237 | A | * | 6/2000 | Hochart | 70/278.7 X |

FOREIGN PATENT DOCUMENTS

| | | | | |
|---|---|---|---|---|
| CH | 103170 | * | 1/1924 | 70/283 |
| DE | 37 12 300 | | 10/1988 | |
| EP | 96400 | * | 12/1983 | 70/283 |
| EP | 160470 | * | 11/1985 | 70/283 |
| EP | 462 316 | | 12/1991 | |
| EP | 712 981 | | 5/1996 | |
| FR | 2 655 367 | | 6/1991 | |
| GB | 2 024 922 | | 1/1980 | |
| IT | 308285 | * | 5/1933 | 70/283 |
| WO | WO 95/20088 | | 7/1995 | |

OTHER PUBLICATIONS

Ueno Yasuo, "Cylinder Lock", EPO Patent Abstracts of Japan, No. 07317385 dated Dec. 5, 1995, Kokusai Gijutsu Kaihatsu KK application 06112632 dated May 26, 1994 (1 page).

* cited by examiner

*Primary Examiner*—Lloyd A. Gall
(74) *Attorney, Agent, or Firm*—Rankin, Hill, Porter & Clark LLP

(57) ABSTRACT

A locking device for a lock cylinder (12) has an electronically controlled inhibiting element (2), which in an inhibit position ($x_S$) blocks movement of a rotor (1) relative to a stator (6) and frees the rotor (1) in a free position ($x_F$). A drive (9) exerts a working force ($F_A$) on the inhibiting element (2), by which inhibiting element (2) can be reversibly transferred from the inhibit position ($x_S$) into the free position ($x_F$) and vice versa. A guide (52–57) is connected to the drive (9) and, at least outside the free position ($x_F$), clearly defines the position of the inhibiting element (2). A restoring device (3) exerts a restoring force ($F_R$) directed away from the free position ($x_F$) on the inhibiting element (2), when that element is between the free position ($x_F$) and a rest position ($x_O$). In the rest position ($x_O$) and in positions between the rest position ($x_O$) and the free position ($x_F$), the inhibiting element inhibits movement of the rotor (1). The locking device is resistant to external, undesired vibration and/or shock effects or magnetic action.

17 Claims, 8 Drawing Sheets

LOCKING DEVICE

FIELD OF THE INVENTION

This invention relates to a locking device usable in locking systems in buildings, vehicles, furniture, safes, switchgear cabinets, key-operated switches, etc. The invention also relates to a method for preventing the opening of a locking device.

BACKGROUND OF THE INVENTION

Locking devices with mechanically and electronically controlled blocking or inhibiting elements are known. They have all the properties of conventional, purely mechanical locking devices. The additional, electronically controlled locking system also provides the possibility of individually activating and inhibiting keys. Thus, such mechanical-electronic locking devices lead to additional flexibility in the locking organization.

Electronically controlled locking is based on data transmission between a key-side electronic module and a lock-side electronic module. This data transmission can take place by contact, e.g., by electrical contacts on the key and lock, or without contact, e.g., by electromagnetic induction. Data can be transmitted in only one or in both directions. By means of the transmitted data a check is made in the lock-side electronic module as to whether the inserted key is access authorized. If this is the case, a lock-side motor is activated, which moves an additional, electronically controlled inhibiting element in such a way that it frees or releases the lock cylinder.

Known mechanical-electronic locking devices are particularly susceptible to vibration and/or shock effects, or to magnetic effects. By suitable external actions of these types, it is possible to transfer the electronically controlled inhibiting element from its inhibit position into the free or release position. Thus, the electronically controlled locking means can be opened with purely mechanical and/or magnetic means, without insertion of an appropriate electronically coded key. For this purpose, a constant frequency vibration can be externally applied to the locking mechanism. If the frequency is appropriately chosen, the electronically controlled inhibiting element resonantly vibrates and modifies its position as a result of scarcely foreseeable interactions with other elements. A further unblocking action can be obtained by impacts or blows on the locking mechanism. As is known, a pulse can be formed from monochromatic vibrations, so that the vibration can be looked upon as a special impact case. Vibrations or impulses are propagated as sound waves in the lock cylinder. As a result of the complicated internal structure of the lock cylinder, it is scarcely possible to calculate beforehand its propagation and action on individual elements within the lock cylinder. Further, external influences can take place with magnetic forces. Bypassing of the electronically controlled locking system by external influences is, of course, undesired.

SUMMARY OF THE INVENTION

An object of the invention is to provide a mechanical-electronic locking device which is resistant to external influences, particularly vibration and/or shock effects or magnetic actions, and which ensures reliable operation.

The invention is based on an analysis of the mechanical processes taking place when opening an inhibiting or blocking element by vibration and/or shock effects. As a result of these external influences the inhibiting element preferably resonantly vibrates and the necessary restoring forces are exerted by its attachment to the motor. When the locking device is subjected to resonant vibrations, parasitic forces act intermittently on the inhibiting element and on the motor. Mechanisms can come into effect which aid movement of the inhibiting element in one direction and prevent it in the other, in the manner of a ratchet. Such mechanisms can result from asymmetric damping, feedback of other oscillating or vibrating elements, etc. As a result, during its external action, the inhibiting element can be moved in one direction and, in the worst case, toward the "free position", i.e., the position in which it releases the lock cylinder. Thus, a sufficiently large number of parasitic impulses of force is enough to transfer the inhibiting element from its inhibit position into the free position.

To prevent the locking device from being opened in this way, according to the invention, at least in the area around the free position, an additional force, termed a "restoring force", is exerted on the inhibiting element and is opposed to the parasitic forces. If the amount of this restoring force is greater than the critical force, e.g., the maximum parasitic force occurring during a force impulse, the inhibiting element can no longer move in an uncontrolled manner toward the free position.

However, an additional risk is inherent in exerting a restoring force on the inhibiting element. As is known, a mobile mass on which a restoring force acts forms an oscillator with at least one resonant frequency. Such an oscillator can be resonantly vibrated by excitation with a suitable frequency and the amplitude of these vibrations, as a function of the damping present, can be very considerable. Under this effect, the locking device could be undesirably opened by external influences.

In order to prevent this, freely vibrating masses are avoided to the greatest possible extent in the locking device and method according to the invention. For this purpose, the position of the inhibiting element is clearly predetermined by suitable guidance means which prevents resonant vibrations of the mass of the inhibiting element.

The locking device according to the invention has at least one electronically controlled inhibiting element, hereinafter simply referred to as an "inhibiting element", having at least one degree of freedom of movement. As a result of this inhibiting element, a rotor and stator of the lock cylinder are mutually lockable. If the inhibiting element is to block the locking cylinder, it should be in a specific, first position, hereinafter called the "inhibit position". In a second position, hereinafter called the "free position", the inhibiting element releases or frees the lock cylinder.

The locking device according to the invention has drive means for exerting a working force on the inhibiting element. By means of the working force the inhibiting element can be reversibly transferred from the inhibiting position into the free position and vice versa.

A locking device according to the invention also has guidance means connected to the drive means to clearly determine the inhibiting element position, at least outside the free position.

A locking device according to the invention also has restoring means connected, on the one hand, to a support immovable relative to the stator and, on the other hand, to the inhibiting element. The restoring means exerts a restoring force on the inhibiting element which is directed away from the free position if the inhibiting element is in the area around the free position. According to the invention, the inhibiting element must inhibit or block in the vicinity of the free position.

Beside the inhibit position and the free position, the inhibiting element preferably also has a third defined position, known as the "rest position", in which the restoring means exerts no force on the inhibiting element. The inhibiting element inhibits the lock cylinder in the rest position. The restoring means exerts on the inhibiting element a restoring force directed away from the free position when the inhibiting element is between the free position and the rest position and the inhibiting element inhibits the lock cylinder in the rest position and in positions between the rest position and the free position.

The free position is preferably located in such a way that a maximum working force and/or a maximum distance or travel, i.e., a maximum energy, is required in order to transfer the inhibiting element from the rest position into the free position. It is then substantially impossible to open the locking device solely with vibration and/or shock actions, without operating the drive means. The drive means can exert a working force on the inhibiting element which is higher than the particular restoring force.

The resistance to vibration and/or shock action is additionally increased if the inhibiting position is so positioned that a maximum distance or travel is required in order to transfer the inhibiting element from the inhibit position into the free position. If, e.g., the inhibiting element can perform linear translations along a given path, then preferably the free position is at the first end of the path, the inhibit position is at the second end of the path and the rest position is in the center of the path. The driving-back force always acts toward the center of the path, i.e., toward the rest position, where, according to the invention, the inhibiting element is already exerting an inhibiting action. However, in other embodiments the rest position can coincide with the inhibit position or can be omitted.

In the method of the invention for preventing opening of a locking device by parasitic forces caused by vibration and/or shock effects, to avoid freely vibrating or oscillating masses, the position of the inhibiting element is clearly predetermined by guidance means. At least in the vicinity of the free position, a restoring force is exerted on the inhibiting element which is opposed to the parasitic forces.

BRIEF DESCRIPTION OF THE DRAWINGS

Hereinafter the locking device according to the invention and, for comparison purposes, also the prior art are described in detail with reference to the attached schematic drawings wherein.

DETAILED DESCRIPTION OF PREFERRED EMBODIMENTS

Figure 1:
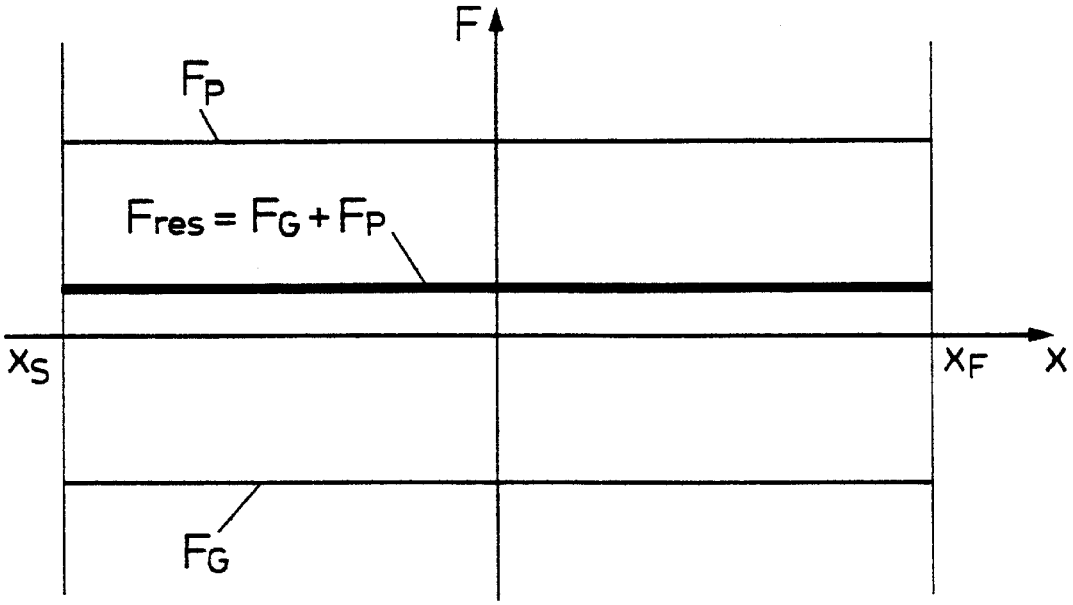
FIG. 1 PRIOR ART
FIG. 1 is a force/distance diagram for a locking device according to the prior art.
Figure 2:
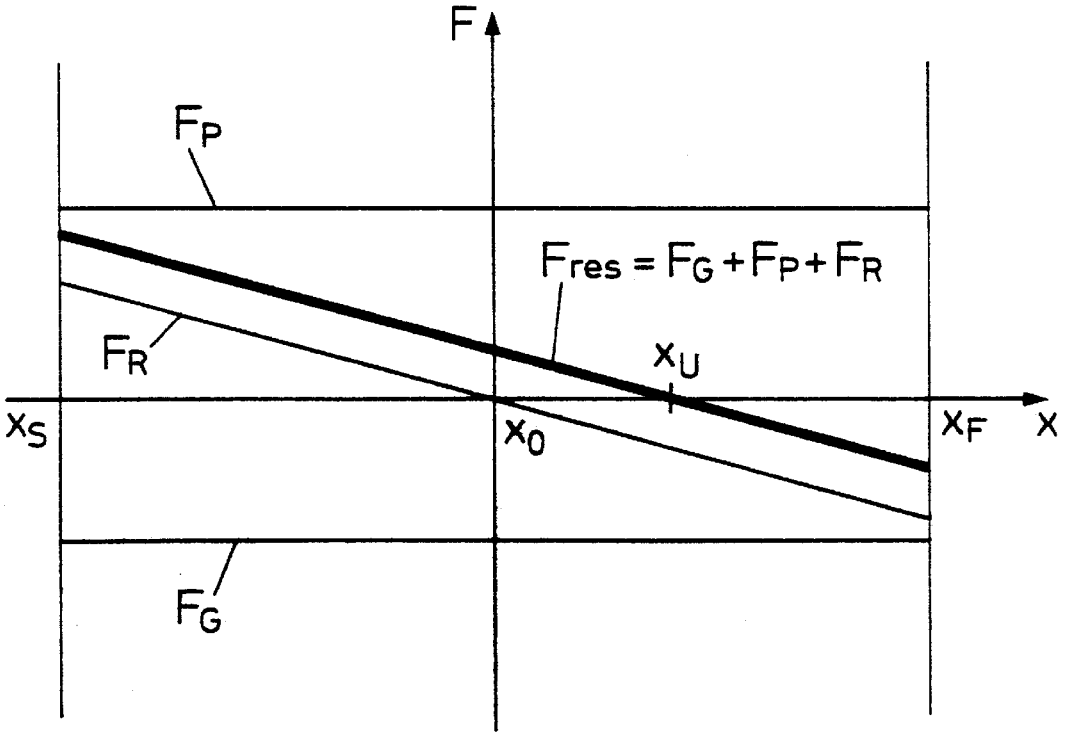
FIG. 2 is a force/distance diagram for a locking device according to the invention.

In each of FIGS. 1 and 2 are plotted forces F(x) on an inhibiting or blocking element as a function of a space coordinate x along which the inhibiting element can move and in which:

$x_S$ is an inhibit position, i.e., the position to be occupied by the inhibiting element when it blocks or inhibits movement of the lock cylinder, i.e., the rotor and stator are mutually locked;

$x_F$ is a release or free position, i.e., the position to be occupied by the inhibiting element in which it releases or frees the lock cylinder for movement to the stator;

$x_O$ is a rest position, i.e., the inhibiting element position in which, in the locking device according to the invention, no restoring force acts on the inhibiting element.

The inhibiting element must only release the lock cylinder in the free position $x=x_F$, whereas it must inhibit the same in positions $x<x_F$, particularly also for $x=x_S$ and $x=x_O$. The convention applies in FIGS. 1 and 2 that positive forces F>0act in the positive x-direction and negative forces F<0, in the negative x-direction.

FIG. 1 is a force/distance diagram for a prior art locking device. An undesired, parasitic force $F_P>0$, directed toward the free position $x_F$, acts on the inhibiting element. The parasitic force $F_P$ is, e.g., a maximum force acting on the inhibiting element when it is resonantly vibrated by external effects. It is assumed in this example that $F_P$ is independent of x. The locking system opposes the parasitic force $F_P$, with a maximum opposing force $F_G<0$. The resulting force on the inhibiting element is consequently $F_{res}=F_G+F_P$. If now, as in the simple example of FIG. 1, $F_P>|F_G|$, then $F_{res}>0$. This means that the inhibiting element is accelerated toward the free position $X_F$. In other words, if the external action persists long enough, it is able to open the locking device.

The conditions are completely different in FIG. 2, which is a force/distance diagram for a locking device according to the invention. According to the invention, an additional restoring force $F_R(x)$, exerted by restoring means, acts on the inhibiting element. The restoring force $F_R(x)$ is directed toward the rest position $x_O$, i.e. $F_R(x<x_O)>0$, $F_R(x>x_{O)<}0$, and disappears in the rest position, i.e., $F_R(x_O)=0$. In the example of FIG. 2, Hooke's law $F_R(x)=kx$ applies, k being a spring constant. The resulting force on the inhibiting element is now $F_{res}=F_G+F_P+F_R$. FIG. 2 shows that $F_{res}$ is only directed toward the free position $x_F$ up to a reversal point $x_u$, i.e., $F_{res}(x<x_{U)>}0$. Between the reversal point $x_u$ and the free position $x_F$, $F_{res}$ is directed away from the free position $x_F$, i.e., $F_{res}(x>x_U)<0$. When a parasitic force $F_P$ is applied, at the most the inhibiting element moves up to the reversal point $x_U$, where the inhibiting element is still inhibiting the lock cylinder and moves no further. Thus, the locking device according to the invention cannot be opened by vibration and/or shock effects.

Figure 3:
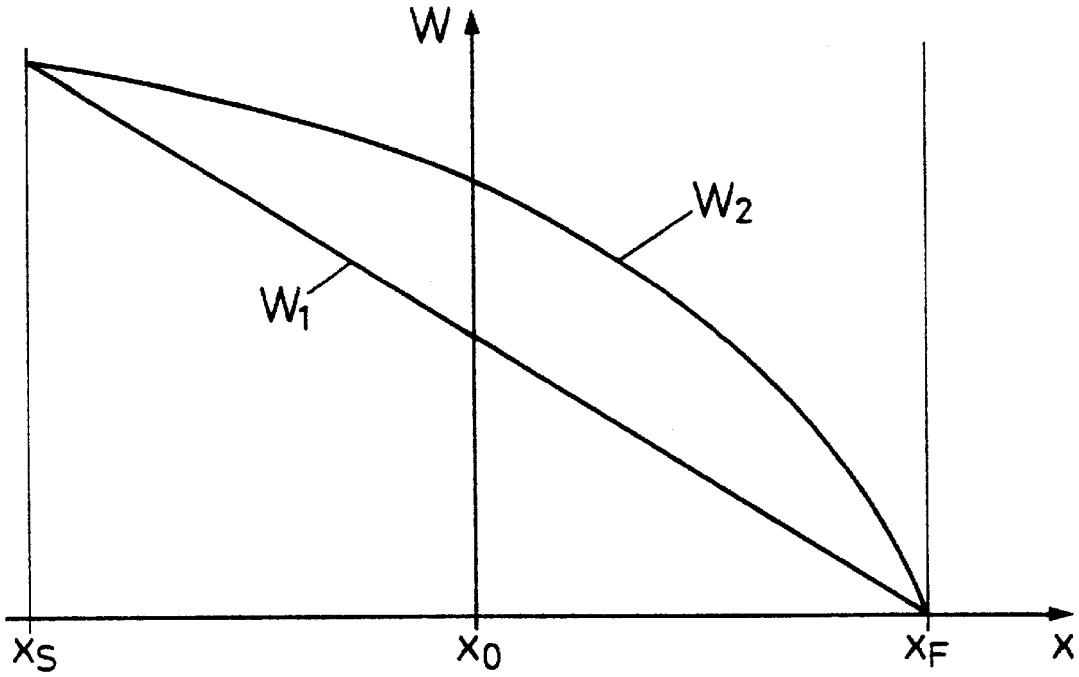
FIG. 3 is a work/distance diagram for a locking device according to the invention and a prior art locking device.

Whereas FIGS. 1 and 2 consider the forces acting on the inhibiting element, FIG. 3 shows the work W(x) required in order to move the inhibiting element from a place $x<x_F$ to the free position $x_F$. The same assumptions are made as in FIGS. 1 and 2 with respect to the acting forces. The curve $W_1(x)$ corresponds to the prior art situation shown in FIG. 1 wherein F is independent of x. In this case, the work $W_1(x)$ necessary for opening decreases linearly with x. Curve $W_2(x)$ corresponds to the situation of FIG. 2, i.e., the present invention, where $F_{res}$ is linearly dependent on x. In this case, the work $W_2(x)$ necessary for opening is quadratically dependent on x. The most important information provided by FIG. 3 is that the work W(x) necessary for opening purposes in a locking device according to the invention is higher (or at the most the same) than in the prior art locking device: $W_2(x)>W_1(x)$ for $x_S<x<x_F$. For certain values of x, in a locking device according to the invention, two to three times greater work is required for opening than in known locking devices. This once again shows that the invention prevents an undesired opening by external influences.

If it is found that the threshold given by curve $W_2(x)$ is too low for certain parasitic forces, the curve $W_2(X)$ can be further raised by suitable measures.

FIGS. 2 and 3 show a special case, because the rest position $x_O$ is in the center between the inhibit position $x_5$ and the free position $x_F$. Naturally, this need not be the case. The locking device according to the invention could, e.g., be designed in such a way that the rest position $x_O$ is beyond the inhibit position $x_S$, i.e., $x_O<x_S$. In this case, the restoring force $F_R$ would be directed away from the free position in all positions of the inhibiting element, i.e., $F_R(x<x_F)<0$. The reversal point $x_U$ in FIG. 2 would be even further removed from the free position $x_F$ and the difference between the necessary work values $W_1(x)$, $W_2(x)$ in FIG. 1 would be even greater so that such an embodiment could be advantageous.

Figure 4:
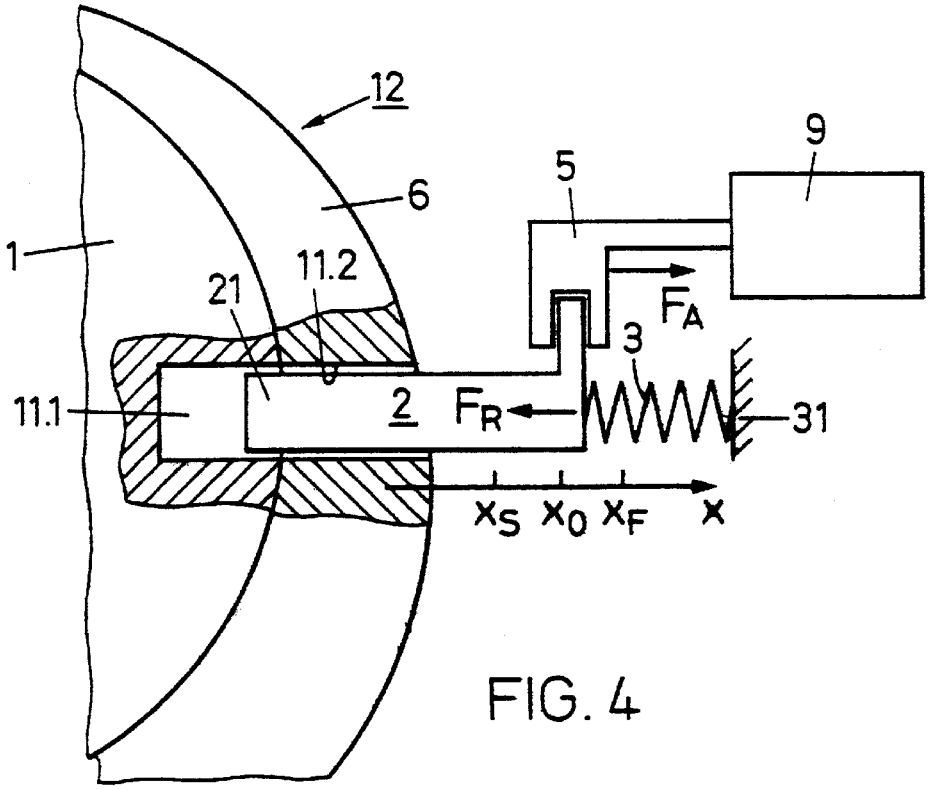
FIG. 4 is a schematic partially sectional view of part of a locking device in accordance with the invention.

FIG. 4 schematically shows part of a locking device according to the invention. A lock cylinder 12 incorporates a rotor 1 and a stator 6 surrounding the rotor. Rotor 1 is provided with a bore 11.1, which communicates with a passage 11.2 through stator 6. An inhibiting element 2 constructed as a tumbler pin extends through passage 11.2 and enters bore 11.1 and is movable in the radial direction x. For as long as an end piece 21 of inhibiting element 2 is located in bore 11.1, rotor 1 is inhibited, i.e., rotor 1 and stator 6 are mutually locked by the inhibiting element. This applies for all positions $x<x_F$ of inhibiting element 2. Only in a free position $x_F$ is inhibiting element 2 removed from rotor 1 so that the rotor is freely movable relative to stator 6.

FIG. 4 also schematically shows drive means 9 which can exert a working force $F_A$ on inhibiting element 2 by which element 2 can be reversibly transferred from inhibit position $x_S$ into free position $x_F$ and vice versa. Drive means 9, e.g., can be an electric motor, electric magnet, etc., which is electrically operated, its operation being activated by insertion or removal of an access-authorized key (not shown in FIG. 4). A battery, not shown, can, e.g., be used as a power supply for drive means 9.

In FIG. 4 a spring symbolizes restoring means 3. The restoring means is, on the one hand, connected to a support 31 immovable relative to stator 6 and, on the other, to inhibiting element 2. The spring exerts a restoring force $F_R$, directed away from free position $x_F$, on inhibiting element 2 which is located between the free position $x_F$ and a rest position $x_O$. Drive means 9 can act on inhibiting element 2 with a working force $F_A$ in order to transfer element 2 in a controlled manner from inhibit position $x_S$ into free position $x_F$ or vice versa.

Drive means 9 is connected to a guidance means 5 which guides inhibiting element 2 by clearly defining its position. This prevents inhibiting element 2 from being resonantly vibrated on restoring means 3 under the action of vibrations externally applied to the lock. In other words, guidance means 5 prevents freely vibrating masses.

FIGS. 5 and 11 to 13 schematically show different to embodiments of the locking device according to the invention and mainly differ in their guidance means.

Figure 5:
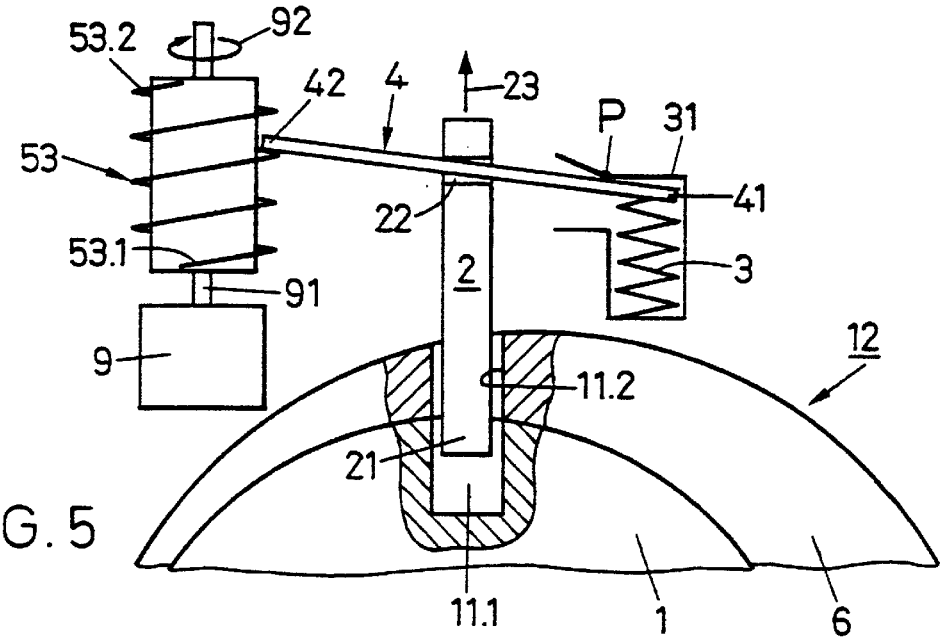
FIG. 5 is a partially sectional view of a first, preferred embodiment of the inventive locking device.

FIG. 5 shows a first, preferred embodiment of the locking device according to the invention. Inhibiting element 2 is constructed as a tumbler pin which is substantially radially movable in a lock cylinder. Inhibiting element 2 extends through passage opening 11.2 of stator 6 communicating with bore 11.1 of rotor 1 and, in the inhibit position, is inserted into bore 11.1. However, if end piece 21 of tumbler pin 2 is further out and lies completely within stator 6, rotor 1 can rotate unhindered (provided that any mechanically controlled inhibiting elements also free the rotor).

In this embodiment, the drive means comprises an electric motor 9 with a drive shaft 91. The torque generated by electric motor 9 and transmitted by drive shaft 91 can be converted into the working force $F_A$ required for the reversible movement of tumbler pin 2. This conversion is brought about by a thread 53 non-rotatably attached to the drive shaft.

In this embodiment, tumbler pin 2 is connected to a force transfer means 4 through which it is possible to transfer working force $F_A$ and/or restoring force $F_R$ from drive means 9 or restoring means 3 to tumbler pin 2. Force transfer means 4 is, e.g., constructed as a lever. The connection between tumbler pin 2 and lever 4 can be implemented positively, e.g., by passing lever 4 through a hole 22 in tumbler pin 2.

In this embodiment, the restoring means is a helical spring 3, which presses a first end 41 of the lever 4 against a support 31. Lever 4 is pivotable about a fulcrum P of support 31, but is not necessarily fixed in fulcrum P, so that as a two-sided lever it transfers the restoring force $F_R$ of helical spring 3 to tumbler pin 2.

A second, guided end 42 of lever 4 is held or guided substantially without clearance and in a positive manner by thread 53 which acts as the guidance means. In this embodiment, thread 53 is a single-start, external thread with several turns surrounding drive shaft 91. By rotating thread 53 through several revolutions, guided end 42 of lever 4 can be moved toward first end 53.1 or second end 53.2 of thread 53. Correspondingly, by lever action the tumbler pin 2 is radially moved and, as a function of the tumbler position, rotor 1 is blocked or free to move relative to stator 6. FIG. 5 shows tumbler pin 2 in a position in which it inhibits rotor 1. If thread 53 rotates in the direction of arrow 92, the tumbler pin moves in the direction of arrow 23, substantially radially outwardly toward the free position.

In the inhibit position, guided end 42 of lever 4 is on first end 53.1 of thread 53 and tumbler pin 2 is embedded far into rotor 1. In the rest position, guided end 42 of lever 4 is in the center of thread 53 and tumbler pin 2 still blocks rotor 1. In the free position, guided end 42 of lever 4 is on second end 53.2 of thread 53 and rotor 1 is now free. Thus, the ends 53.1, 53.2 of thread 53 are associated with the inhibit position and the free position, respectively.

In both the inhibit and free positions, thread 53 can continue to rotate, without it having any consequences for the position of tumbler pin 2. This offers the advantage that the drive motor does not have to be stopped precisely at the point of reaching the particular end position. Guided end 42 of lever 4 remains on the particular end 53.1, 53.2 of the thread and, during a thread revolution, at the most performs a small upward or downward movement. However, if the rotation direction of thread 53 or the drive motor is reversed in such a position 53.1, 53.2, the guided end 42 of lever 4 is forced by the restoring force $F_R$ back into the thread 53. To bring about this advantageous effect, the rest position must be between the inhibit position and the free position.

As a result of external vibration and/or shock effects, tumbler pin 2 can admittedly in certain circumstances be brought from the inhibit position into the rest position, but even then the rotor 1 remains blocked. It is not possible with the locking device according to the invention to bring tumbler pin 2 further out of the rest position into the free position by vibration or shock effects, because the force $F_R$ of restoring means 3 counteracts in a restoring manner such a movement. Restoring force $F_R$ is higher the further tumbler pin 2 moves from the rest position toward the free position, which further increases security.

Figure 6:
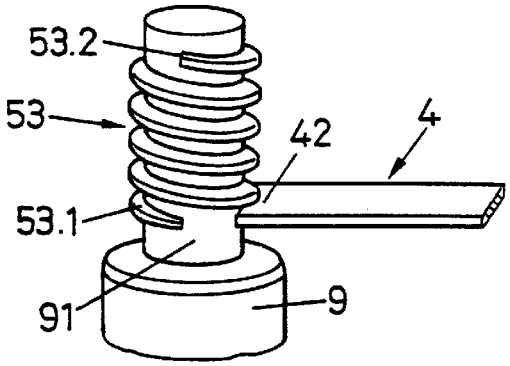
FIGS. 6 and 8 are perspective views of part of the embodiment of FIG. 5 in different positions.
Figure 7:
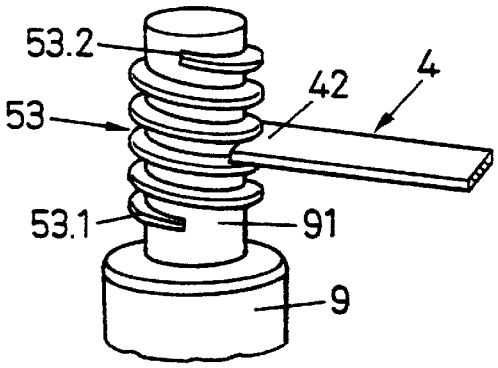
Figure 8:
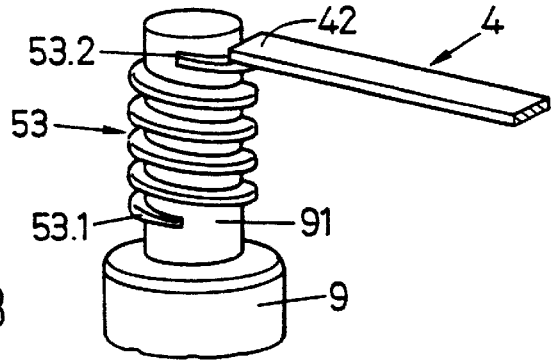

FIGS. 6, 7 and 8 show a drive motor 9, thread 53 with ends 53.1, 53.2, drive shaft 91 and guided end 42 of lever 4 in accordance with the embodiment of FIG. 5 in the inhibit position, rest position and free position, respectively.

Figure 9:
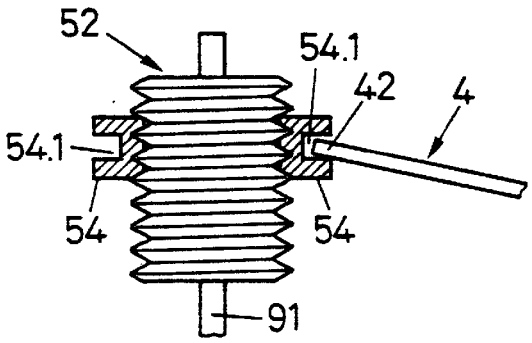
FIGS. 9 and 10 are side elevations of two variations of devices usable in the embodiment of FIG. 5.
Figure 10:
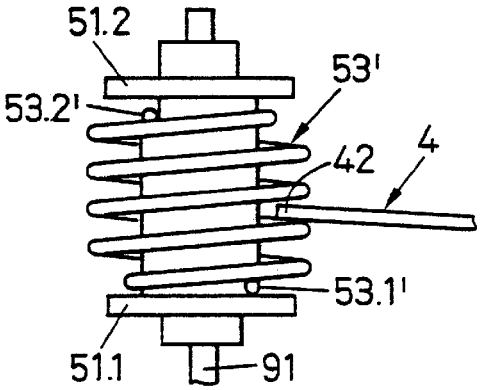

FIGS. 9 and 10 show details of possible modifications to the embodiment of FIG. 5, namely, slightly different ways of guiding guided end 42 of the lever 4 along a thread.

In FIG. 9, guided end 42 of lever 4 does not directly engage in a thread, but is instead positively guided and held by a groove 54.1 in a nut 54. Nut 54 is moved up and down by a suitable screw thread 52. The remaining elements of the locking device of FIG. 6 can have the same construction and same positioning as in FIG. 5.

In FIG. 10, thread 53 is replaced by turns 53' surrounding the drive shaft 91 and which are connected to the shaft, e.g., only at a first end 53.1' and a second end 53.2'. The turns 53' can, e.g., be bounded by end plate boundaries 51.1, 51.2.

Figure 11:
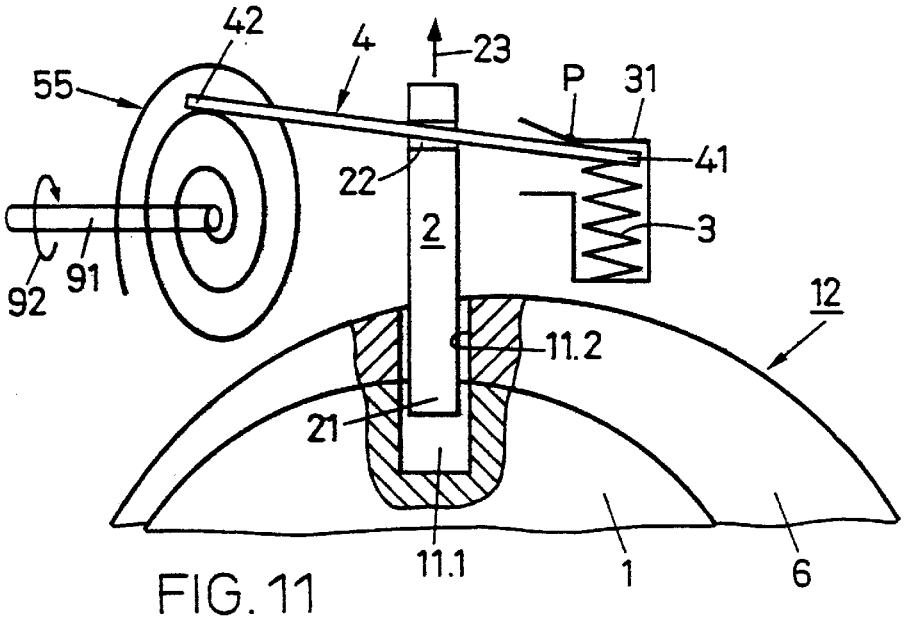
FIG. 11 to 13 are partially sectional views of further embodiments of the inventive locking device.

FIG. 11 shows another embodiment of a locking device according to the invention. Lever 4, as the force transfer means, is guided by a helix or spiral 55 as the guidance means, shown in perspective, in that second end 42 of lever 4 engages positively between the spiral turns. By means of a shaft 91, spiral 55 is rotated by a motor, not shown. In the inhibit position, guided end 42 of lever 4 is in the vicinity of shaft 91. If spiral 55 is rotated by the motor in the appropriate direction (indicated by an arrow 92), it presses guided end 42 of lever 4 outwardly and away from shaft 91. The free position is reached after several motor revolutions. In the free position, guided end 42 of lever 4 is on the outer circumference of spiral 55. Here again, the motor need not stop rotating immediately when the sought position is reached.

Figure 12:
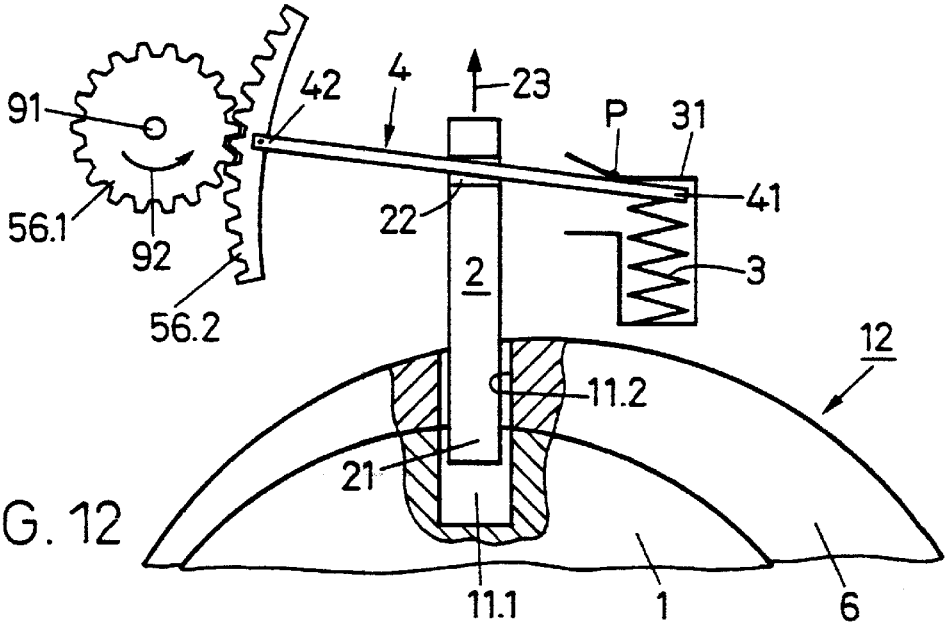

In the embodiment of FIG. 12 the guidance means for lever 4 or electronically controlled tumbler pin 2 comprise a toothed gear or pinion 56.1 engaging a gear segment or segment gear 56.2. Gear or pinion 56.1 meshes with gear segment 56.2 fixed to guided end 42 of lever 4. A motor (not shown in FIG. 12), acting through a shaft 91 drives gears 56.1, 56.2 and consequently moves or controls tumbler pin 2. The transmission ratio of gear 56.1 to gear segment 56.2 is preferably large, so that several motor revolutions are required for transferring tumbler pin 2 from the inhibit position into the free position.

Figure 13:
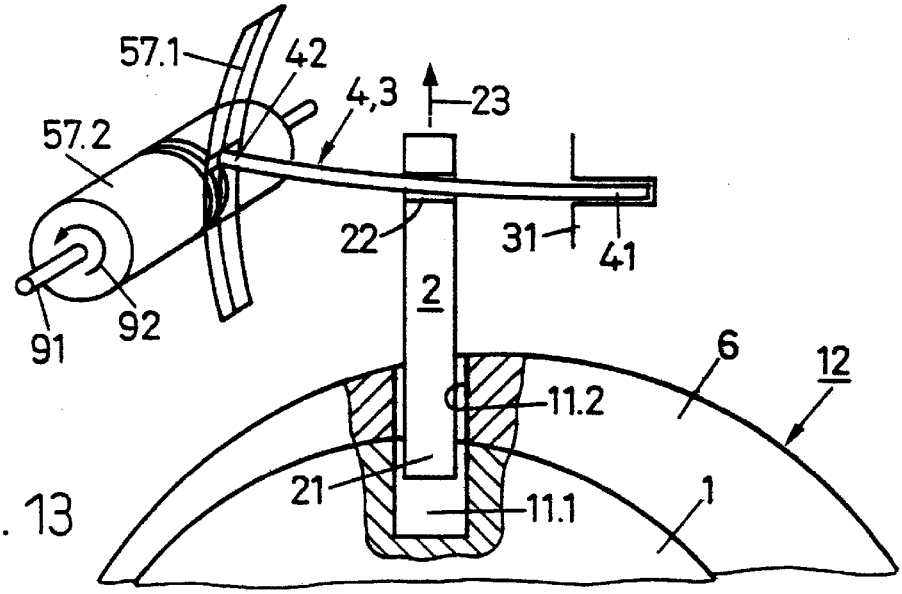

Another embodiment of a locking device according to the invention is schematically shown in FIG. 13. The guidance means comprises a tension belt or wire 57.1, to which is attached guided end 42 of lever 4. Tension belt or wire 57.1 is wound one or more times round a roll 57.2 and is forced to participate in rotations of roll 57.2 by static friction. Roll 57.2 is driven by a motor (not shown) by a shaft 91. The circumference of roll 57.2 is preferably small compared with the length of tension belt or wire 57.1, so that several roll revolutions are required for transferring tumbler pin 2 from the inhibit position into the free position.

Figure 14:
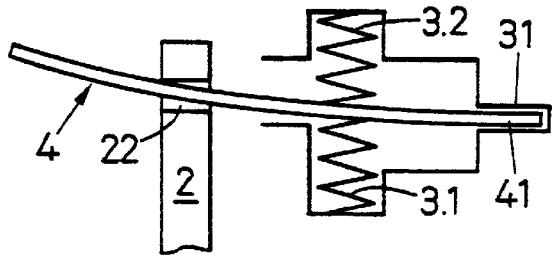
FIG. 14 is a detail of a further embodiment of the inventive device.

In FIG. 13 the force transfer means 4 is itself resilient, e.g., constructed as a leaf spring. First end 41 of lever 4 is fixed in support 31. In this case, leaf spring or lever 4 simultaneously acts as a force transfer means and as a restoring means. Obviously, it is possible to combine this embodiment with the restoring means of FIGS. 5, 11 or 12 constructed as a helical spring 3, as shown in FIG. 14, wherein the first end 41 of lever 4 is firmly fixed in support 31 and two helical springs 3.1 and 3.2 act as restoring means on the lever 4.

Figure 15:
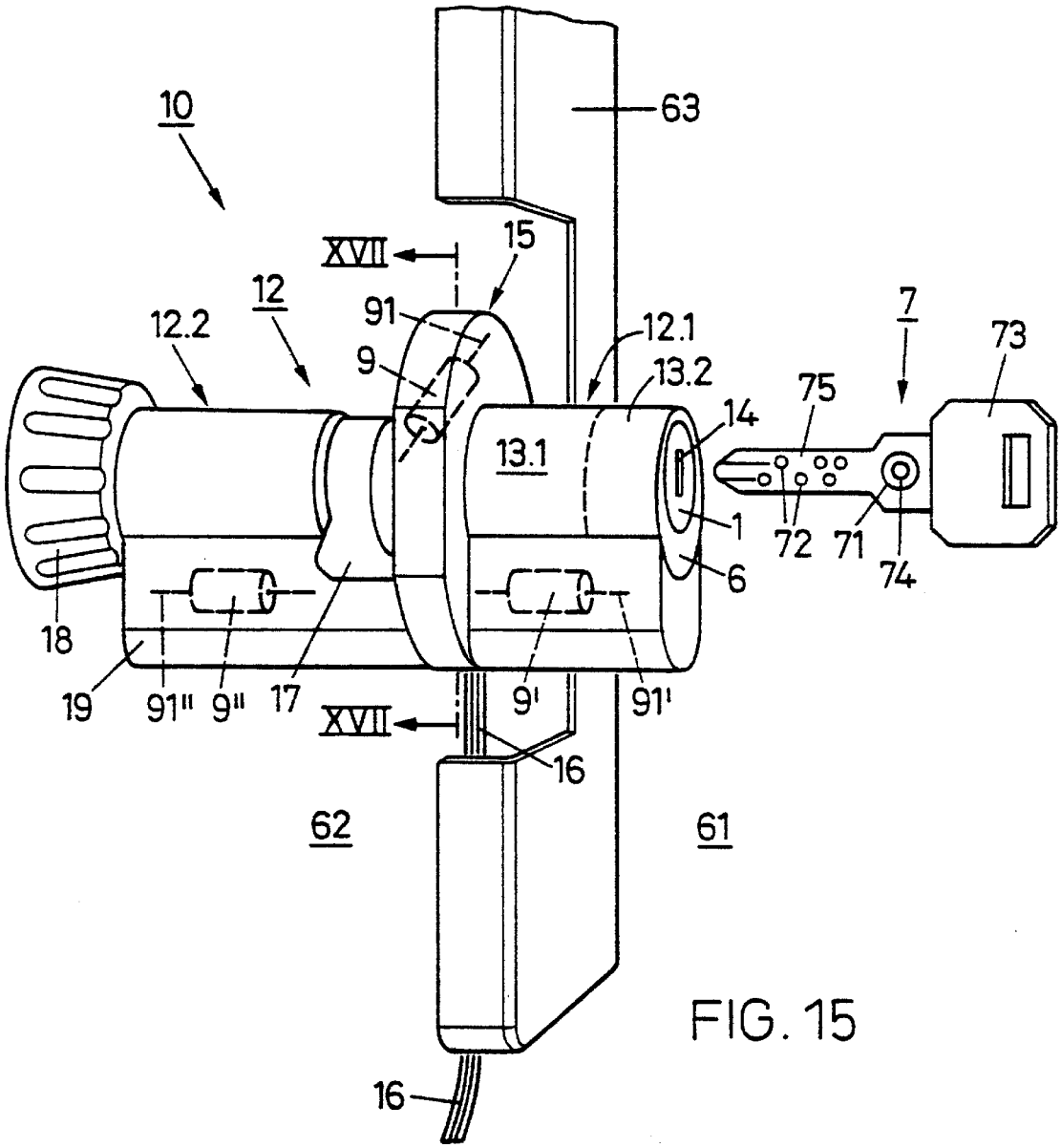
FIGS. 15 and 16 are perspective views of two further embodiments of a lock module with a locking device according to the invention.

FIG. 15 is a perspective, partly exposed view of a first embodiment of a lock module 10, or part of a lock with a locking device according to the invention, installed in a door (not shown). The lock module 10 has a double lock cylinder 12, a first partial cylinder 12.1 being directed toward the outside 61 of the door and a second partial cylinder 12.2 on the inside 62 of the door. First partial cylinder 12.1 contains a mechanical section 13.1 and an electronic section 13.2, these two sections 13.1, 13.2 also being able to pass into one another so that they need not be clearly mutually defined. A key opening or keyhole 14 on the outside of the door is formed in a rotor 1. An electric cable 16 connects lock module 10 with a lock-side electronic module (not shown in detail) and serves to electrically transmit power for operating drive means 9 and/or information. Between first partial cylinder 12.1 and second partial cylinder 12.2 is provided a conventional lock bit 17 for operating a conventional door lock (not shown). From the door inside 62 can, e.g., project a rotary knob 18. Alternatively, the door inside 62 can be provided with a keyhole. The lock can be protected by a lock plate 63 attached to the outside 61 of the door.

The lock module shown in FIG. 15 also has a collar 15, in which can be housed the inventive, electronically controlled locking device. In this embodiment, electric motor 9 (shown in broken line form) is positioned on the circumference of lock cylinder 12 and its drive shaft 91 extends substantially perpendicularly to the longitudinal direction of lock cylinder 12. Alternatively, electric motor 9' or 9" can be housed in a web 19, e.g., in the vicinity of first partial cylinder 12.1 or second partial cylinder 12.2. In this case, electric motor 9', 9" is then also located on the circumference of the lock cylinder 12, but its drive shaft 91' or 91" is substantially parallel to the longitudinal direction of lock cylinder 12. For reasons of simplicity, FIG. 15 does not show some of the elements of the electronically controlled locking device.

A key 7 with a key head 73 and a key bit 75 can be inserted in the keyhole 14 and, e.g., carries on key bit 75 electrical contacts 71 for data transmission from key 7 into electronic section 13.2 of first partial cylinder 12.1. Any electronic components and/or integrated circuits 74 can, e.g., be located in key bit 75 or key head 73. Key 7 can also have mechanical coding means 72 on the key bit 75.

Figure 16:
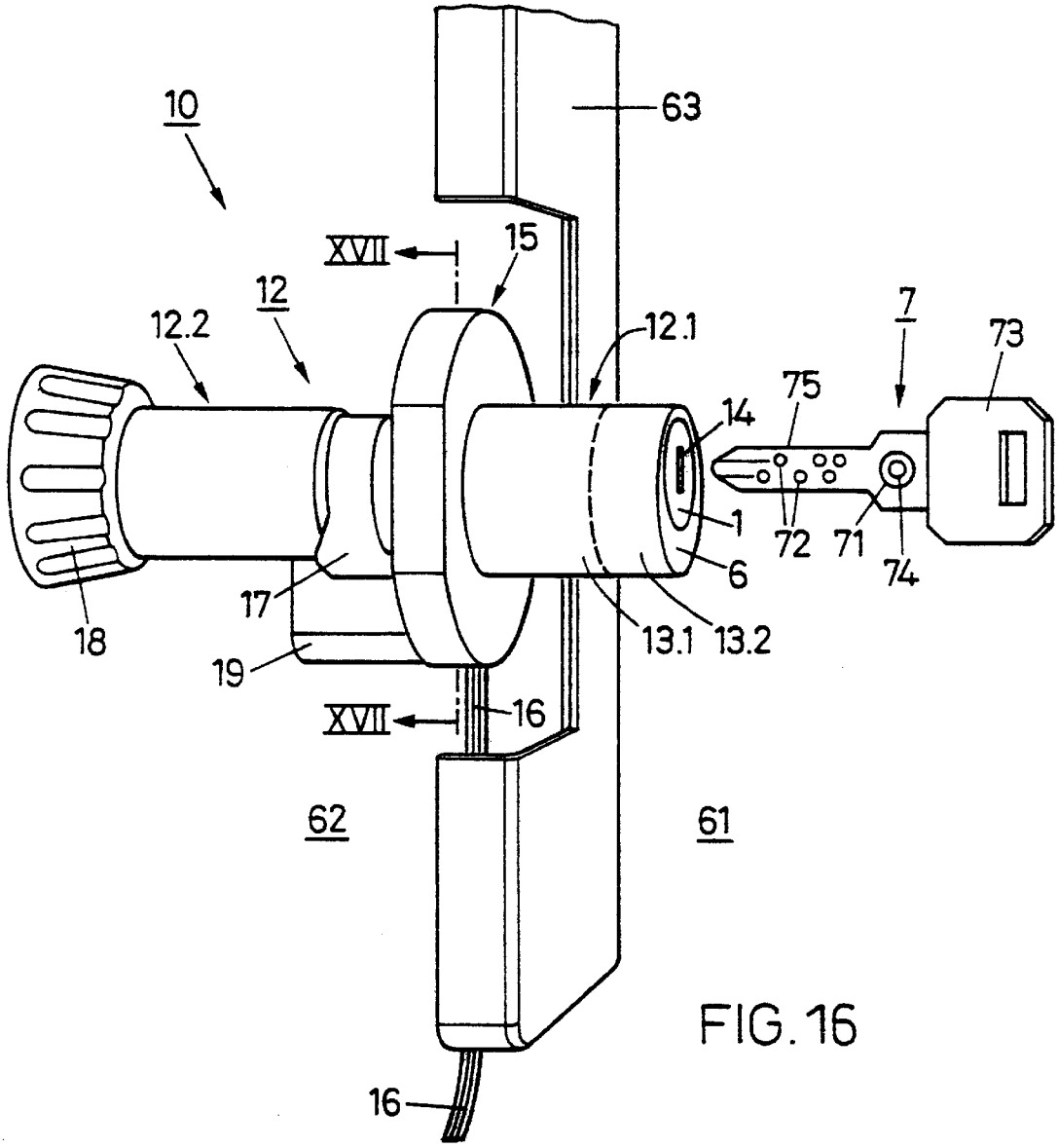

FIG. 16 shows an embodiment of a lock module 10 differing slightly from FIG. 15. In FIG. 16, web 19 is short, so the lock module 10 complies with other installation standards.

Figure 17:
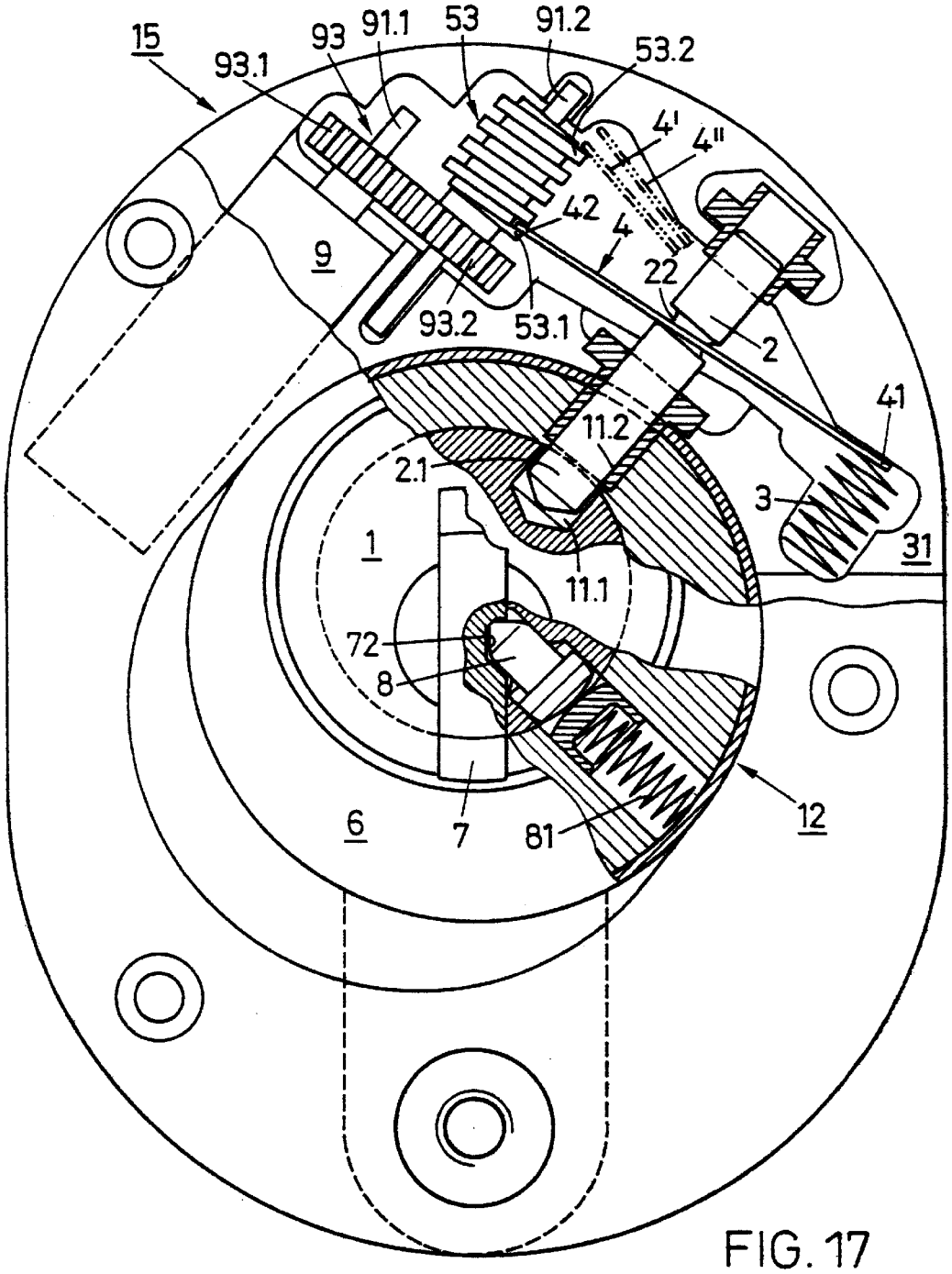
FIG. 17 is a transverse sectional view through a collar of the lock module along line XVII—XVII of either of FIGS. 15 or 16.

FIG. 17 shows a cross-section through collar 15 of FIGS. 15 or 16. The embodiment of the inventive locking device shown in FIG. 15 essentially corresponds to that of FIG. 5. Lock cylinder 12 comprises a stator 6 and a rotor 1 rotatably mounted therein. An electronically controlled tumbler pin 2 is moved by an electric motor 9 by a thread 53, acting as a guidance means, and a lever 4. Between electric motor 9 and thread 53 is a gear train 93 with, e.g., two intermeshed gears 93.1, 93.2. Such a gear train 93 can be advantageous if, for geometrical reasons, e.g., due to confined space circumstances, thread 53 cannot be directly attached to drive shaft 91.1 of the electric motor and instead has its own drive shaft 91.2. It can also adapt, in a manner suitable for thread 53, the force or speed of electric motor 9.

Lever 4 serves as a force transfer means and at its unguided end 41 is pressed by a helical spring 3 onto casing 31 of lock module 15. Helical spring 3 serves as a restoring means. Electronically controlled tumbler pin 2 is shown approximately in the rest position.

In addition to being shown in the rest position, an end of lever 4 is shown in dot-dash lines in the free position (4') and the extreme position (4") outside the free position. In the free position, tumbler pin 2 releases rotor 1 from stator 6. If rotor 1 is then rotated, it presses tumbler pin 2, having a conical end 2.1, still further outward, so that lever 4 is moved to its extreme position 4", where second end 42 of lever 4 is at such a distance from thread 53 that thread 53 cannot engage end 42 when electric motor 9 rotates thread 53. As a result of this construction principle, the malfunction is avoided in which, even though second end 42 of lever 4 is guided by thread 53 toward first thread end 53.1, rotor 1 would still be in a position which would not allow the tumbler pin 2 to be inserted into bore 11.1 and consequently follow the movement of lever 4.

In lock cylinder 12 there can also be at least one mechanically controlled tumbler pin 8 on which a pre-tensioned pin spring 81 acts. Mechanically controlled tumbler pin 8 with a suitable mechanical coding system 72 is acted on by key 7 inserted in the lock cylinder 12. It is obviously possible to have several mechanically controlled tumbler pins. There can also be several electronically controlled locking elements.

Exerting a working force for transferring inhibiting element 2 from the inhibit position into the free position is initiated by inserting key 7, associated with lock cylinder 12, in the rotor 1 or a rotary movement in or with rotor 1. Conversely, exerting the working force for transferring inhibiting element 2 from the free position into the inhibit position is initiated by extracting the key from rotor 1.

What is claimed is:

1. A locking device in combination with a lock cylinder, said lock cylinder including a rotor (1) and a stator (6), said combination comprising:

at least one electronically controlled inhibiting element (2) movable to mutually lock said rotor and said stator, said inhibiting element being movable between a locking position in which said rotor is immovably locked relative to said stator and a free position in which said inhibiting element has no inhibiting effect on said rotor and stator;

drive means for exerting a working force ($F_A$) on said at least one electronically controlled inhibiting element to reversibly move said at least one electronically controlled inhibiting element between said locking position and said free position;

wherein, guidance means connected to said drive means (9) clearly determine the position of said at least one electronically controlled inhibiting element (2) at least when said electronically controlled inhibiting element is outside said free position;

restoring means connected to a support (31) immovable relative to said stator and connected via force transfer means (4) to said at least one electronically controlled inhibiting element for exerting a restoring force urging said at least one electronically controlled inhibiting element away from said free position when said at least one electronically controlled inhibiting element is near said free position but is inhibiting movement of said rotor relative to said stators wherein said at least one electronically controlled inhibiting element is movable to a rest position ($x_O$) in which said restoring means exerts no force onto said inhibiting element and in which said at least one electronically controlled inhibiting element inhibits movement of said rotor relative to said stator; and, wherein said restoring means exerts a restoring force on said at least one electronically controlled inhibiting element directed away from said free position when said at least one electronically controlled inhibiting element is between said free position and said rest position, said at least one electronically controlled inhibiting element inhibits movement of said rotor in said rest position and in positions between said rest position and said free position.

2. A combination according to claim 1 wherein said rotor comprises a bore and said stator has a passage alignable with said bore, said at least one electronically controlled inhibiting element extending through said passage and into said bore in said locking position.

3. A combination according to claim 2 wherein said at least one electronically controlled inhibiting element comprises a tumbler pin movable generally radially relative to said rotor and stator.

4. A combination according to claim 1 wherein said drive means comprises an electric motor (9) having a drive shaft (91), and means for converting output torque of said drive shaft into force ($F_A$) for movement of said at least one electronically controlled inhibiting element.

5. A combination according to claim 4 wherein said motor (9) is on a circumference of said lock cylinder and wherein said drive shaft (91) is substantially perpendicular to a longitudinal direction of said lock cylinder (12).

6. A combination according to claim 4 wherein said motor (9) is on a circumference of said lock cylinder and wherein said drive shaft (91) is substantially parallel to a longitudinal direction of said lock cylinder (12).

7. A combination according to claim 1 wherein said guidance means comprises a generally helical thread.

8. A combination according to claim 1 wherein said guidance means comprises a generally helical guide surface.

9. A combination according to claim 1 wherein said guidance means comprises a toothed gear.

10. A combination according to claim 1 wherein said guidance means comprises a tension belt or wire.

11. A combination according to claim 1 wherein said guidance means comprises a generally helical guide surface having a plurality of turns around a drive shaft (91) and wherein ends of said guide surface define said locking position ($x_S$) and said free position ($x_F$), respectively.

12. A combination according to claim 11, wherein said force transfer means is connected to said at least one electronically controlled inhibiting element and is operable to transfer working force and restoring force from said drive means or said restoring means to said at least one electronically controlled inhibiting element.

13. A combination according to claim 12 wherein said force transfer means comprises a lever, one end of said lever engaging said guide surface.

14. A combination according to claim 11 wherein said force transfer means comprises a lever, and wherein one end of said lever engages two adjacent turns of said guide surface substantially without clearance.

15. A combination according to claim 1 wherein said restoring means comprises at least one helical spring (3).

16. A combination according to claim 1 including at least one mechanically controlled inhibiting element (8).

17. A combination according to claim 1 including a key (7) associated with said lock cylinder, and wherein operation of said key in or into said lock cylinder initiates exerting of said working force ($F_A$) to transfer said at least one electronically controlled inhibiting element from said locking position ($x_S$) to said free position ($x_F$), and wherein removal of said key from said lock initiates transfer of said at least one electronically controlled inhibiting element from said free position ($x_F$) to said locking position ($x_S$).

* * * * *

UNITED STATES PATENT AND TRADEMARK OFFICE

CERTIFICATE OF CORRECTION

PATENT NO. : 6,363,762 B1
DATED : April 2, 2002
INVENTOR(S) : Kueng

It is certified that error appears in the above-identified patent and that said Letters Patent is hereby corrected as shown below:

Column 3,
Line 59, delete "FIGS. 6 and 8" and insert -- FIGS. 6, 7 and 8 --.

Column 5,
Line 21, delete "$X_5$" and insert -- $X_s$ --.

Column 6,
Line 5, after "different", delete "to".

Column 59,
Line 59, delete "stators" and insert -- stator --.

Signed and Sealed this

First Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,363,762 B1
DATED : April 2, 2002
INVENTOR(S) : Kueng

It is certified that error appears in the above-identified patent and that said Letters Patent is hereby corrected as shown below:

Column 3,
Line 59, delete "FIGS. 6 and 8" and insert -- FIGS. 6, 7 and 8 --.

Column 5,
Line 21, delete "$X_5$" and insert -- $X_s$ --.

Column 6,
Line 5, after "different", delete "to".

Column 9,
Line 59, delete "stators" and insert -- stator --.

This certificate supersedes Certificate of Correction issued October 1, 2002.

Signed and Sealed this

Seventeenth Day of December, 2002

JAMES E. ROGAN
*Director of the United States Patent and Trademark Office*